US006450182B2

(12) United States Patent
Fillipi et al.

(10) Patent No.: US 6,450,182 B2
(45) Date of Patent: Sep. 17, 2002

(54) METHODS, COMPOSITIONS AND APPARATUS FOR CLEANING PIPES

(75) Inventors: Gregory M. Fillipi, Norman; Bobby E. Walls, Drumwright; Kenneth Magerus, Nicoma Park; Jerry L. Gore, Midwest City, all of OK (US)

(73) Assignee: Versar, Inc., Springfield, VA (US)

( * ) Notice: Subject to any disclaimer, the term of this patent is extended or adjusted under 35 U.S.C. 154(b) by 0 days.

(21) Appl. No.: 09/828,952

(22) Filed: Apr. 10, 2001

Related U.S. Application Data

(60) Provisional application No. 60/196,296, filed on Apr. 12, 2000.

(51) Int. Cl.[7] ..... B08B 9/00

(52) U.S. Cl. ..... 134/22.1; 134/18; 134/19; 134/22.11; 134/22.12; 134/22.14; 134/22.19; 134/26; 134/30; 134/34; 134/35; 134/36; 134/37; 134/40; 134/42; 134/95.1; 134/95.2; 134/113; 134/169 R; 134/169 C; 510/412; 510/421; 422/124; 422/125; 422/126; 73/28.01; 73/61.71

(58) Field of Search ..... 134/18, 19, 22.1, 134/22.11, 22.12, 22.14, 22.19, 26, 30, 34, 35, 36, 37, 40, 42, 113, 95.2, 95.1, 169 C, 169 R; 73/61.71, 28.01; 510/421, 412; 422/124, 125, 126

(56) References Cited

U.S. PATENT DOCUMENTS 4,587,032 A * 5/1986 Rogers ..... 252/174.17
4,619,709 A * 10/1986 Fiocco ..... 134/22.14
4,711,256 A 12/1987 Kaiser ..... 134/25.4

(List continued on next page.)

FOREIGN PATENT DOCUMENTS

GB 2261364 5/1993

OTHER PUBLICATIONS

"A Novel Method and Apparatus for Cleaning Oxygen Service Equipment via a Surfactant–Enhanced Fluorocarbon Solvent", Crowe, Christy L., A thesis submitted to the Graduate School in partial fulfillment of the requirements for the Degree Master of Science in Chemical Engineering, New Mexico State University, Las Cruces, New Mexico, Dec., 1999 (copy of pages i, ii, 114 and 115).
"Krytox performance lubricants", 5 pages obtained at the web site www.dupont.com on Feb. 13, 2000.

(List continued on next page.)

*Primary Examiner*—Sharidan Carrillo
(74) *Attorney, Agent, or Firm*—Bacon & Thomas, PLLC

(57) ABSTRACT

The present invention cleans contaminants from pipes. The first step may be pulling a vacuum on the pipe to be cleaned. The pipe is then filled with a solvent, which is preferably a fluorocarbon solvent. After the pipe is filled with solvent, a cleaning solution is pumped at a high velocity through the pipe. The cleaning solution preferably comprises the fluorocarbon solvent, and a fluorosurfactant. The pipe is then rinsed with solvent. A particle counter is used to determine whether the solvent rinse contains an acceptably low number of particles. The solvent is then blown out of the pipe by a gas, such as dry air. A vacuum is then pulled on the pipe. Subsequently, a hot dry gas is pumped through the pipe to evaporate and remove any remaining solvent. The gas is preferably hot, dry air. The gas exiting from the pipe is then checked to confirm that it contains an acceptably low level of solvent vapor.

8 Claims, 1 Drawing Sheet

U.S. PATENT DOCUMENTS

| | | | | | |
|---|---|---|---|---|---|
| 5,039,349 | A | * | 8/1991 | Schoeppel | 134/26 |
| 5,288,422 | A | * | 2/1994 | Basu et al. | 252/174 |
| 5,289,838 | A | * | 3/1994 | Odell | 134/166 R |
| 5,298,083 | A | * | 3/1994 | Van Der Puy et al. | 134/42 |
| 5,350,458 | A | * | 9/1994 | Pinsl-Ober et al. | 134/22.1 |
| 5,397,398 | A | * | 3/1995 | Van Vlahakis et al. | 134/22.11 |
| 5,440,824 | A | | 8/1995 | Ramachandran | 34/443 |
| 5,520,837 | A | * | 5/1996 | Antin et al. | 252/135 |
| 6,048,832 | A | * | 4/2000 | Thenappan et al. | 510/410 |
| 6,110,885 | A | * | 8/2000 | Chan | 510/473 |

OTHER PUBLICATIONS

3M HFEs (Hydrofluoroethers) For Aircraft Cleaning, 6 pages obtained at the web site www.3m.com on Mar. 12, 2000.

"Still looking for a fluid you can live with?", 24 pages obtained at the web site www.3m.com on Mar. 12, 2000.

"Methods, Compositions and Apparatus for Cleaning Surfaces" , U.S. Utility Patent Application No. 09/775,641 filed Feb. 5, 2001.

* cited by examiner

METHODS, COMPOSITIONS AND APPARATUS FOR CLEANING PIPES

This application claims the benefit of provisional application No. 60/196,296 filed Apr. 12, 2000.

FIELD OF THE INVENTION

This invention relates to the field of cleaning the surfaces within pipes. The surfaces may be metal, including stainless steel. The restricted points of entry may prevent these surfaces from being cleaned by application of mechanical force or sonic energy. The contaminants to be cleaned from the surfaces include organic matter and particulates.

BACKGROUND OF THE INVENTION

The oxygen supply systems on aircraft may comprise oxygen converters, oxygen regulators, molecular sieve oxygen generators (MSOG units), oxygen pipes which are more commonly referred to as oxygen lines, and other apparatus. The cleaning of these oxygen supply systems is required primarily to remove two types of contamination. The first type of contamination arises from organic compounds. These organic compounds include jet fuel, compounds that result from the incomplete combustion of jet fuel, hydraulic oil and special types of greases that are used in these oxygen systems. The second type of contamination arises from particles of dust and dirt, as well as particles of Teflon that are found in the greases that may be used in these oxygen systems, and from Teflon tape which may be used in the threaded connections of these oxygen systems. The particulates may be in a size range of about one to 300 microns, and more commonly, in a size range of about 2 to about 150 microns.

The prior art attempts to clean oxygen lines have involved the use of chlorofluorocarbons, and have generally had unsatisfactory results. Aqueous solvents are unsatisfactory because they are difficult to remove completely and residual water may freeze and create a dangerous buildup of pressure.

There are certain requirements for methods, compositions and apparatus for cleaning the surfaces within aircraft oxygen lines to remove such contaminants. The methods should be able to be carried out in a relatively short period of time. Preferably, the cleaning should be carried out with the minimum removal of components of the oxygen system from the aircraft. The cleaning compositions should be non-aqueous, non-flammable, non-toxic, and environmentally friendly. The solvent of the cleaning compositions should be able to be used as a verification fluid that is circulated through the cleaned components in order to verify cleaning. The apparatus for cleaning should preferably be transportable to the location of the aircraft. The cleaning should achieve at least a level B of ASTM standard G93-96, which may be stated as less than 3 mg/ft$^2$ (11 mg/m$^2$), or less than about 3 mg. of contaminants per square foot of interior surface of the components, or less than about 11 mg. of contaminants per square meter of interior surface of the components. The method of ASTM standard G93-96 may not accurately determine the level of cleanliness in vessels with restricted entry.

There are other installations where clean oxygen lines are required. These include hospitals and physical science research facilities.

SUMMARY OF THE INVENTION

The present invention comprises methods, compositions and apparatus for cleaning the interior surfaces of pipes, and particularly, oxygen lines. These methods, compositions and apparatus have certain features in common, and other features that may be varied depending on the nature of the surfaces to be cleaned.

The present invention achieves the satisfactory cleaning of contaminants from pipes by first pulling a vacuum on the pipe to be cleaned. The pipe is then filled with a solvent, which is preferably a fluorocarbon solvent. After the pipe is filled with solvent, a cleaning solution is pumped at a high velocity through the pipe. The cleaning solution preferably comprises the fluorocarbon solvent, and a fluorosurfactant. The pipe is then rinsed with solvent. A particle counter is used to determine whether the solvent rinse contains an acceptably low number of particles. The solvent is then blown out of the pipe by a gas, such as dry air. A vacuum is then pulled on the pipe to evaporate the solvent. Subsequently, a hot dry gas is pumped through the pipe to remove any remaining solvent. The gas is preferably hot, dry air. The gas exiting from the pipe is then checked with a halogen detector to confirm that it contains an acceptably low level of solvent vapor.

DETAILED DESCRIPTION OF THE INVENTION

Figure 1:
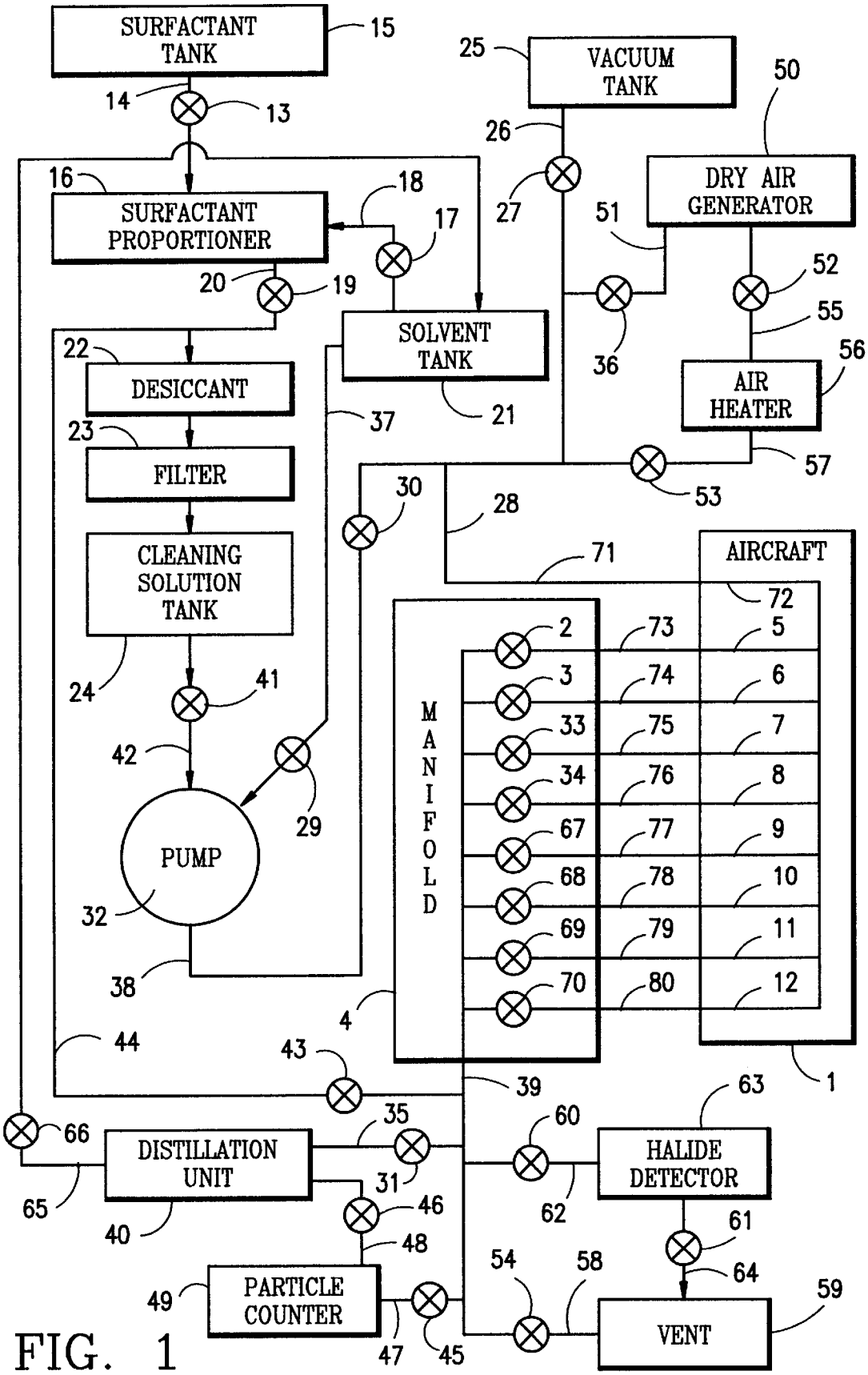
FIG. 1 is a schematic illustration of apparatus embodying the invention.

The solvent may be selected from a number of fluorocarbons. A preferred solvent is HFE301 which is a hydrofluoroether available from 3M, and which comprises methyl heptafluoropropyl ether ($C_3F_7OCH_3$). A more preferred solvent is HFE-7100, which is a mixture of methyl nonafluorobutyl ether, Chemical Abstracts Service No. 163702-08-7, and methyl nonafluoroisobutyl ether, Chemical Abstract Service No. 163702-07-06. HFE-7100 generally comprises about 30–50 percent of methyl nonafluorobutyl ether and about 50–70 percent of the methyl nonafluoroisobutyl ether. A third solvent is FC-72, which is Chemical Abstract Service No. 865-42-1, and comprises a mixture of fluorinated compounds with six carbons. A fourth solvent is FC-77 which is Chemical Abstract Service No. 86508-42-1, and comprises a mixture of perfluorocompounds with 8 carbons. A preferred group of solvents comprises segregated ethers which comprise a hydrocarbon group on one side of the ether oxygen (—O—) and a fluorocarbon group on the other side.

The surfactant of the present invention may be selected from the following fluorosurfactants, or similar fluorosurfactants. The preferred surfactant is L11412 which is available from 3M, and which is a perfluorocarbon alcohol, 100% volatile, and a clear, colorless liquid, with a boiling point in the range of from about 80° C. to about 90° C. and a specific gravity of about 1.8 g./ml. A second surfactant is Krytox alcohol, which is a nonionic fluorosurfactant that comprises hexafluoropropylene oxide homopolymer. A third surfactant is Zonyl UR, which is an anionic flurosurfactant. It comprises Telomer B phosphate, which is known by Chemical Abstracts Service No. 6550-61-2. A fourth surfactant is Krytox 157FS, which is a perfluoropolyether carboxylic acid, Chemical Abstracts Service No. 51798-33-5-100.

A preferred cleaning composition comprises from about 0.001% to about 5% by weight surfactant, and more preferably from about 0.05% to about 0.5% by weight surfactant. In a preferred embodiment, there is about 0.05% by weight of the surfactant in the cleaning composition of the present invention.

The methods and apparatus of the present invention are more fully disclosed in FIG. 1 and the following description.

The apparatus of the present invention is preferably housed in a trailer or other vehicle which is parked adjacent the aircraft. An aircraft may have one or more oxygen lines. In some aircraft, there is one oxygen line for each oxygen mask that is worn by a crew member. Each aircraft oxygen line may be provided with an oxygen regulator. In practicing the invention, the oxygen regulator is typically removed from each aircraft oxygen line before it is connected to the apparatus of the present invention.

In FIG. 1, aircraft 1 is shown comprising eight oxygen lines 5, 6, 7, 8, 9, 10, 11 and 12. The apparatus of the present invention comprises hose 71 which is adapted to be attached to line 72 which is the main terminus of all of the oxygen lines. Manifold 4 is provided with hoses 73, 74, 75, 76, 77, 78, 79 and 80, which are adapted to be attached to the terminus of oxygen lines 5, 6, 7, 8, 9, 10, 11 and 12, respectively. Manifold 4 is provided with valves 2, 3, 33, 34, 67, 68, 69 and 70 to allow selective communication between oxygen lines 5, 6, 7, 8, 9, 10, 11 and 12, respectively, on the one hand, and line 39 on the other hand.

In a method according to the present invention, valve 13 in line 14 is opened. This allows concentrated surfactant from surfactant tank 15 to flow through line 14 to surfactant proportioner 16. The concentrated surfactant may be from about 8% to about 15% by weight of the solvent. After surfactant proportioner 16 is filled with a fixed volume of concentrated surfactant, valve 13 is closed. Valve 17 in line 18 is opened, and valve 19 in line 20 is opened. A fixed volume of solvent from solvent tank 21 is pumped by a pump (not shown) through line 18 to surfactant proportioner 16. The fixed volume of concentrated surfactant from surfactant proportioner 16 and the fixed volume of solvent from solvent tank 21, flow through line 20, through desiccant 22, through filter 23 and into cleaning solution tank 24. Valves 17 and 19 are closed. The foregoing steps may be repeated until a predetermined amount of cleaning solution is present in cleaning solution tank 24.

Vacuum pump 25 is turned on and evacuates line 26. Hoses 71, 73, 74, 75, 76, 77, 78, 79 and 80 are attached to aircraft oxygen lines 72, 5, 6, 7, 8, 9, 10, 11 and 12, respectively. Valve 27 is opened, while valves 2, 3, 33, 34, 67, 68, 69 and 70 are closed. Vacuum pump 25 is used to leak test aircraft oxygen lines 72, 5, 6, 7, 8, 9, 10, 11 and 12 through hose 71 and lines 28 and 26. After a predetermined level of evacuation is achieved, valve 27 is closed. Vacuum pump 25 may be turned off. Valves 2, 3, 29, 30, 31, 33, 34, 67, 68, 69 and 70 are opened. Pump 32 is turned on. Solvent is pumped from solvent tank 21 through line 37, through pump 32, through lines 38 and 28, through hose 71, through aircraft oxygen lines 72 and 5, 6, 7, 8, 9, 10, 11 and 12, through hoses 73, 74, 75, 76, 77, 78, 79 and 80, and through lines 39 and 35 to distillation unit 40. After aircraft oxygen lines 72, 5, 6, 7, 8, 9, 10, 11 and 12 are full of solvent, valves 3, 29, 31, 33, 34, 67, 68, 69 and 70 are closed, and valves 41 and 43 are opened.

Cleaning solution is pumped by pump 32 from cleaning solution tank 24, through line 42, through pump 32, through lines 38 and 28, through hose 71, through aircraft oxygen lines 72 and 5, through hose 73, through lines 39 and 44, through desiccant 22, through filter 23 and into cleaning solution tank 24. Filter 23 should remove a substantial amount of particles. The cleaning solution is pumped by pump 32 through this continuous loop for a predetermined amount of time at a relatively high velocity. The velocity through aircraft oxygen lines 72 and 5 is preferably from about 10 to about 30 feet (about 3.0 to 9.1 meters) per second, and more preferably from about 16 to about 25 feet (about 4.9 to 7.6 meters) per second. After the cleaning solution has been pumped through this loop for a predetermined amount of time, valve 3 is opened and valve 2 is closed. After the cleaning solution has been pumped through this loop for a predetermined amount of time, valve 33 is opened and valve 3 is closed. After the cleaning solution has been pumped through this loop for a predetermined amount of time, valve 34 is opened and valve 33 is closed. After the cleaning solution has been pumped through this loop for a predetermined amount of time, valve 67 is opened and valve 34 is closed. After the cleaning solution has been pumped through this loop for a predetermined amount of time, valve 68 is opened and valve 67 is closed. After the cleaning solution has been pumped through this loop for a predetermined amount of time, valve 69 is opened and valve 68 is closed. After the cleaning solution has been pumped through this loop for a predetermined amount of time, valve 70 is opened and valve 69 is closed. After the cleaning solution has been pumped through this loop for a predetermined amount of time, valves 41 and 43 are closed, and valves 2, 3, 29, 31, 33, 34, 67, 68, 69 and 70 are opened.

Solvent is pumped by pump 32 from solvent tank 21, through line 37, through pump 32, through lines 38 and 28, through hose 71, through aircraft oxygen lines 72, 5, 6, 7, 8, 9, 10, 11 and 12, through hoses 73, 74, 75, 76, 77, 78, 79 and 80, through manifold 4, and through lines 39 and 35 to distillation unit 40. The velocity of the solvent does not have to be a relatively high velocity. After aircraft oxygen lines 72, 5, 6, 7, 8, 9, 10, 11 and 12 have been rinsed with solvent, valves 45 and 46 are opened. Pump 32 continues to pump solvent from solvent tank 21, through line 37, through pump 32, through lines 38 and 28, through hose 71, through aircraft oxygen lines 72, 5, 6, 7, 8, 9, 10, 11 and 12, through hoses 73, 74, 75, 76, 77, 78, 79 and 80, to manifold 4. Solvent is further pumped from manifold 4 through lines 39 and 47, through particle counter 49, and through lines 48 and 35 to distillation unit 40. If the amount of particles in the solvent passing through particle counter 49 is below a predetermined level, then aircraft oxygen lines 72, 5, 6, 7, 8, 9, 10, 11 and 12 have been cleaned. On the other hand, if the amount of particles in the solvent passing through particle counter 49 is not low enough to meet a predetermined level, then the steps of pumping cleaning solution through aircraft oxygen lines 72, 5, 6, 7, 8, 9, 10, 11 and 12 may be repeated.

When aircraft oxygen lines 72, 5, 6, 7, 8, 9, 10, 11 and 12 have been cleaned, pump 32 is turned off, valves 29, 30, 45 and 46 are closed, and valves 31 and 36 are opened. Dry air from dry air generator 50 is forced by a pump or other means (not shown) through lines 51 and 28, and through hose 71 to aircraft oxygen line 72. This forces the remaining solvent out of aircraft oxygen lines 72, 5, 6, 7, 8, 9, 10, 11 and 12, through hoses 73, 74, 75, 76, 77, 78, 79 and 80, through manifold 4, and through lines 39 and 35 to distillation unit 40. After the remaining solvent has been forced out of aircraft oxygen lines 72, 5, 6, 7, 8, 9, 10, 11 and 12, valves 2, 3, 31, 33, 34, 36, 67, 68, 69 and 70 are closed. Valve 27 is opened. Vacuum pump 25 pulls a vacuum through lines 26 and 28 and through hose 71, on aircraft oxygen lines 72, 5, 6, 7, 8, 9, 10, 11 and 12. After a predetermined level of evacuation has been achieved, valve 27 is closed, and valves 2, 3, 33, 34, 67, 68, 69, 70, 52, 53, and 54 are opened.

Dry air from dry air generator 50 is forced by a pump or other means (not shown) through line 55 to air heater 56. Air heater 56 is turned on. Air heater 56 heats the dry air which is further forced through lines 57 and 28, through hose 71, through aircraft oxygen lines 72, 5, 6, 7, 8, 9, 10, 11 and 12, through hoses 73, 74, 75, 76, 77, 78, 79 and 80, through manifold 4, and through lines 39 and 58 to vent 59. After a predetermined amount of heated dry air has been forced through aircraft oxygen lines 72, 5, 6, 7, 8, 9,10, 11 and 12, valves 60 and 61 are opened. The heated dry air exiting from manifold 4 passes through lines 39 and 62, through halide detector 63, and through lines 64 and 58 to vent 59. If the amount of halide detected by halide detector 63 is below a predetermined level, then aircraft oxygen lines 72, 5, 6, 7, 8, 9, 10, 11 and 12 have been dried. On the other hand, if the level of halide that is detected by halide detector 63 is above a predetermined level, then additional hot dry air may be forced through aircraft oxygen lines 72, 5, 6, 7, 8, 9, 10, 11 and 12, until the level of halide is below the predetermined level.

After the level of halide that is detected by halide detector 63 is below the predetermined level, air heater 56 is turned off and valves 2, 3, 33, 34, 52, 53, 60, 61, 67, 68, 69 and 70 are closed. Hoses 71, 73, 74, 75, 76, 77, 78, 79 and 80, may now be disconnected from aircraft oxygen lines 72, 5, 6, 7, 8, 9, 10, 11 and 12, respectively.

Solvent may be recycled before, during or after the steps that are described above, by opening valve 66 and activating distillation unit 40. The solution within distillation unit 40 is heated to vaporize the solvent, and the condensed solvent vapor is gravity fed through line 65 to solvent tank 21.

Variations of the invention may be envisioned by those skilled in the art.

We claim as follows:

1. A method of cleaning a pipe comprising the following steps:

removing particles from a pipe by pumping a cleaning composition through said pipe at a velocity of from about 10 to about 30 feet per second, wherein said cleaning composition comprises a fluorocarbon solvent;

removing said cleaning composition from said pipe;

rinsing said pipe with said fluorocarbon solvent; and determining the cleanliness of said pipe by measuring an amount of said particles in said fluorocarbon solvent.

2. The method of claim 1, wherein said cleaning composition further comprises about 0.05% by weight of a fluorosurfactant in said fluorocarbon solvent.

3. The method of claim 2, wherein said fluorocarbon solvent comprises methyl nonafluorobutyl ether and methyl nonafluoroisobutyl ether.

4. A method of cleaning a pipe comprising the following steps:

removing particles from a pipe by pumping a cleaning composition through said pipe at a velocity of from about 10 to about 30 feet per second, wherein said cleaning composition comprises a fluorocarbon solvent;

removing said cleaning solution composition from said pipe;

rinsing said pipe with said fluorocarbon solvent;

determining the cleanliness of said pipe by measuring an amount of said particles in said fluorocarbon solvent;

evaporating substantially all remaining fluorocarbon solvent in said pipe by reducing pressure in said pipe with a vacuum pump and forcing dry air through said pipe; and determining whether said pipe is dried by measuring the dry air exiting from said pipe.

5. The method of claim 1, wherein said cleaning composition further comprises about 0.05% by weight of a fluorosurfactant in said fluorocarbon solvent.

6. A method of cleaning a pipe comprising the following steps:

mixing a fluorocarbon solvent and a fluorosurfactant to make a cleaning composition;

removing particles from a pipe by pumping said cleaning composition through said pipe at a velocity of from about 10 to about 30 feet per second;

removing said cleaning composition from said pipe;

rinsing said pipe with said fluorocarbon solvent;

determining the cleanliness of said pipe by measuring an amount of said particles in said fluorocarbon solvent;

evaporating substantially all remaining fluorocarbon solvent in said pipe by reducing pressure in said pipe with a vacuum pump and forcing dry air through said pipe; and determining whether said pipe is dried by measuring the dry air exiting from said pipe.

7. The method of claim 6, wherein said cleaning composition comprises about 0.05% by weight of said fluorosurfactant in said fluorocarbon solvent.

8. The method of claim 7, wherein said fluorocarbon solvent comprises methyl nonafluorobutyl ether and methyl nonafluoroisobutyl ether.

* * * * *